US007185839B2

(12) United States Patent
Albritton

(10) Patent No.: US 7,185,839 B2
(45) Date of Patent: Mar. 6, 2007

(54) RAZOR WIRE DISPENSING AND RETRIEVING APPARATUS

(76) Inventor: Samuel H. Albritton, 87 Sammy Jo Rd., Lumberton, MS (US) 39455

( * ) Notice: Subject to any disclaimer, the term of this patent is extended or adjusted under 35 U.S.C. 154(b) by 103 days.

(21) Appl. No.: 11/142,984

(22) Filed: Jun. 3, 2005

(65) Prior Publication Data

US 2006/0273216 A1 Dec. 7, 2006

(51) Int. Cl.
*B65H 57/02* (2006.01)

(52) U.S. Cl. ..... 242/397; 242/400; 242/403; 242/404.2; 242/557; 242/566

(58) Field of Classification Search ..... 242/397, 242/399, 400, 403, 404, 404.2, 406, 557, 242/566

See application file for complete search history.

(56) References Cited

U.S. PATENT DOCUMENTS 3,934,655 A * 1/1976 Whistle ..... 173/46
4,854,521 A * 8/1989 Farnsworth ..... 242/419.9
4,925,435 A * 5/1990 Linklater ..... 474/101
6,042,046 A * 3/2000 Beyer, Sr. ..... 242/559.1
6,065,714 A * 5/2000 Fondacaro ..... 242/557
6,302,156 B1 * 10/2001 Lardet et al. ..... 140/16
7,011,269 B1 * 3/2006 Chouinard et al. ..... 242/557

* cited by examiner

*Primary Examiner*—Patrick Mackey
*Assistant Examiner*—William E. Dondero
(74) *Attorney, Agent, or Firm*—Wiley Hollopeter

(57) ABSTRACT

A razor wire dispensing and retrieving apparatus for installing razor wire along a perimeter to create a protective border and collecting the wire when the border is no longer desired. The razor wire dispensing and receiving apparatus essentially comprises a frame with a wire hanger and a wire spreader. The wire hanger and spreader function to permit efficient dispensing, retrieving, and transport of razor wire. Moreover, the frame attaches to a variety of vehicles, including military vehicles. As the vehicle travels along a perimeter, the apparatus dispenses wire from the hanger while the spreader keeps the wire aligned. The apparatus also includes a means of pivoting the frame on a horizontal axis. Pivoting the frame down from the dispensing position permits the apparatus to be used as a wire-retrieving device. In this position, the wire is loaded back onto the hanger as the spreader keeps the wire aligned. Furthermore, pivoting the frame upward from the dispensing position permits the apparatus to be used as a wire-transporting device. The upward angle of the hanger created by pivoting the frame upward secures the wire for high-speed transportation.

13 Claims, 6 Drawing Sheets

64~

RAZOR WIRE DISPENSING AND RETRIEVING APPARATUS

BACKGROUND OF THE INVENTION

1. Field of the Invention

The present invention relates to a wire dispensing and receiving apparatus for use in connection with installing and recycling razor, or concertina, wire. The wire dispensing and retrieving apparatus has particular utility in connection with promoting safe and efficient unrolling of razor wire. The wire dispensing and retrieving apparatus has further utility in permitting safe and efficient retrieval of used razor wire. Additionally, the apparatus allows for fast transport of wire and easy setup for operation.

2. Description of the Prior Art

Fence dispensing apparatuses facilitate unrolling of fencing wire along a perimeter for creation of a barrier. In fact, the fence installing art is crowded with various apparatuses that dispense fencing wire. However, the existing fence dispensing apparatuses do not permit easy set up and efficient dispensing of razor wire. Additionally, the existing apparatuses fail to provide easy set up for efficient retrieval of used razor wire.

Therefore, a need exists for a new and improved fence dispensing apparatus that efficiently dispenses and retrieves razor wire. The present invention substantially fulfills this need. In this respect, the fence dispensing apparatus according to the present invention substantially departs from the conventional concepts and designs of the prior art, and in doing so provides an apparatus primarily developed for the purpose of efficiently dispensing and retrieving razor wire along a perimeter. Additionally, the apparatus was developed for the purpose of allowing fast transportation of razor wire and easy setup for operation.

SUMMARY OF THE INVENTION

In view of the foregoing disadvantages inherent in the known types of fence dispensing apparatuses now present in the prior art, the present invention provides an improved razor wire dispensing and retrieving apparatus, and overcomes the above-mentioned disadvantages and drawbacks of the prior art. As such, the general purpose of the present invention, which will be described subsequently in greater detail, is to provide a new and improved razor wire dispensing and retrieving apparatus which has many novel features that result in a razor wire dispensing and retrieving apparatus which is not anticipated, rendered obvious, suggested, or even implied by the prior art, either alone or in any combination thereof.

There has thus been outlined, rather broadly, the more important features of the invention in order that the detailed description that follows may be better understood and in order that the present contribution to the art may be better appreciated. The invention may also include attachments to permit use with various vehicles, including military vehicles. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of preferred embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception upon which this disclosure is based may readily be utilized as a basis for the designing of other structures, methods, and systems for carrying out the several purposes of the present invention. Therefore, it is important that the claims be regarded as including such equivalent constructions insofar as they do not depart from the spirit and scope of the present invention.

It is therefore an object of the present invention to provide a new and improved razor wire dispensing and retrieving apparatus that has all of the advantages of the prior art fence dispensing apparatuses and none of the disadvantages.

Another object of the present invention is to provide an apparatus that may be easily loaded with razor wire.

It is another object of the present invention to provide an apparatus that efficiently retrieves used razor wire for recycling.

It is another object of the present invention to provide a new and improved razor wire dispensing and receiving apparatus that may be attached to and transported by a variety of vehicles.

It is another object of the present invention to provide an apparatus that provides for efficient transportation of razor wire.

Most importantly, it is an object of the present invention to provide a new and improved fence dispensing apparatus that improves the overall efficiency in which wire is dispensed or received.

These, together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
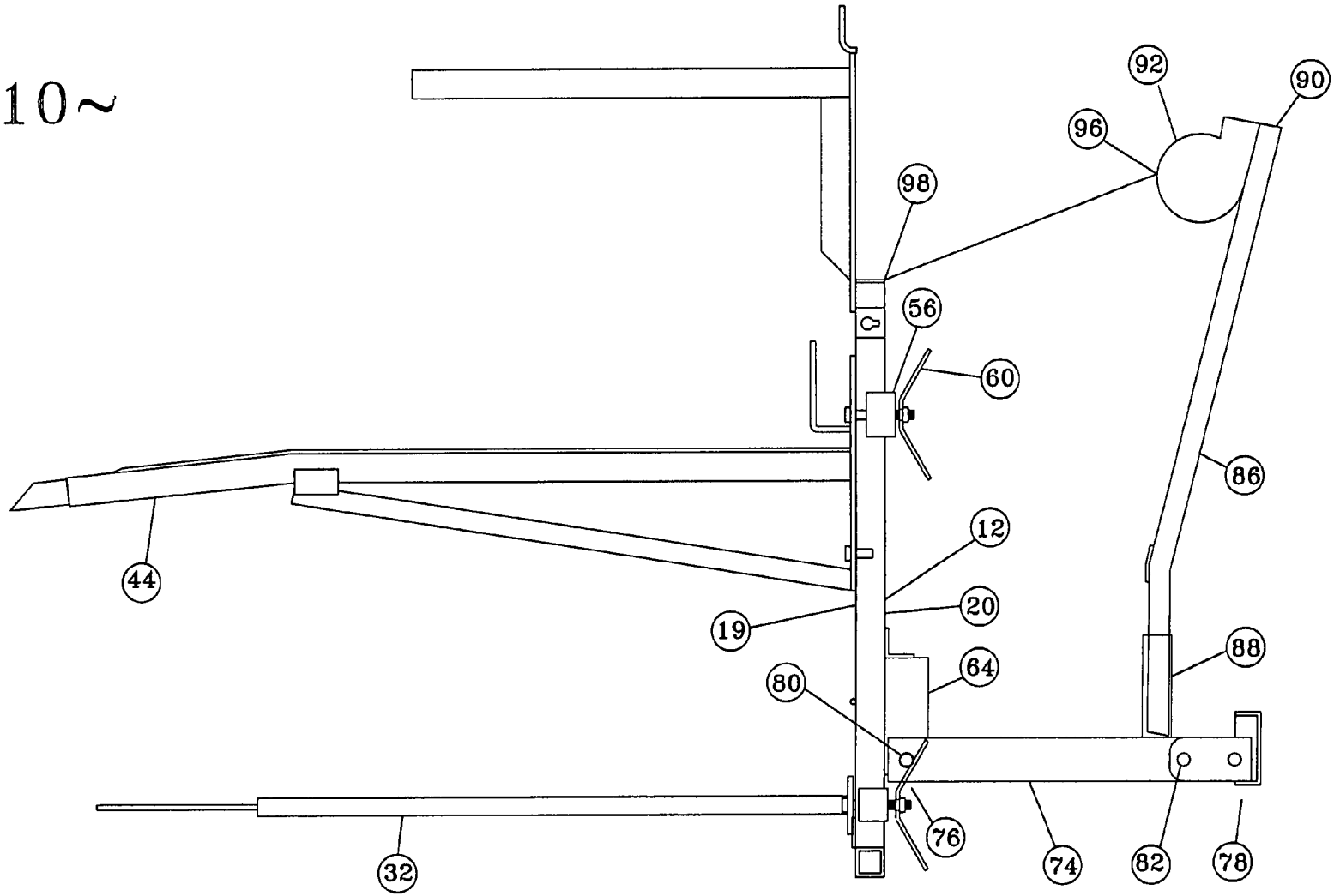
FIG. 1 is a left side view of the preferred embodiment of the wire dispensing and retrieving apparatus constructed in accordance with the principles of the present invention.

Referring now to the drawings, and particularly to FIGS. 1–6, a preferred embodiment of the razor wire dispensing and retrieving apparatus of the present invention is shown and generally designated by the reference numeral 10.

Figure 2:
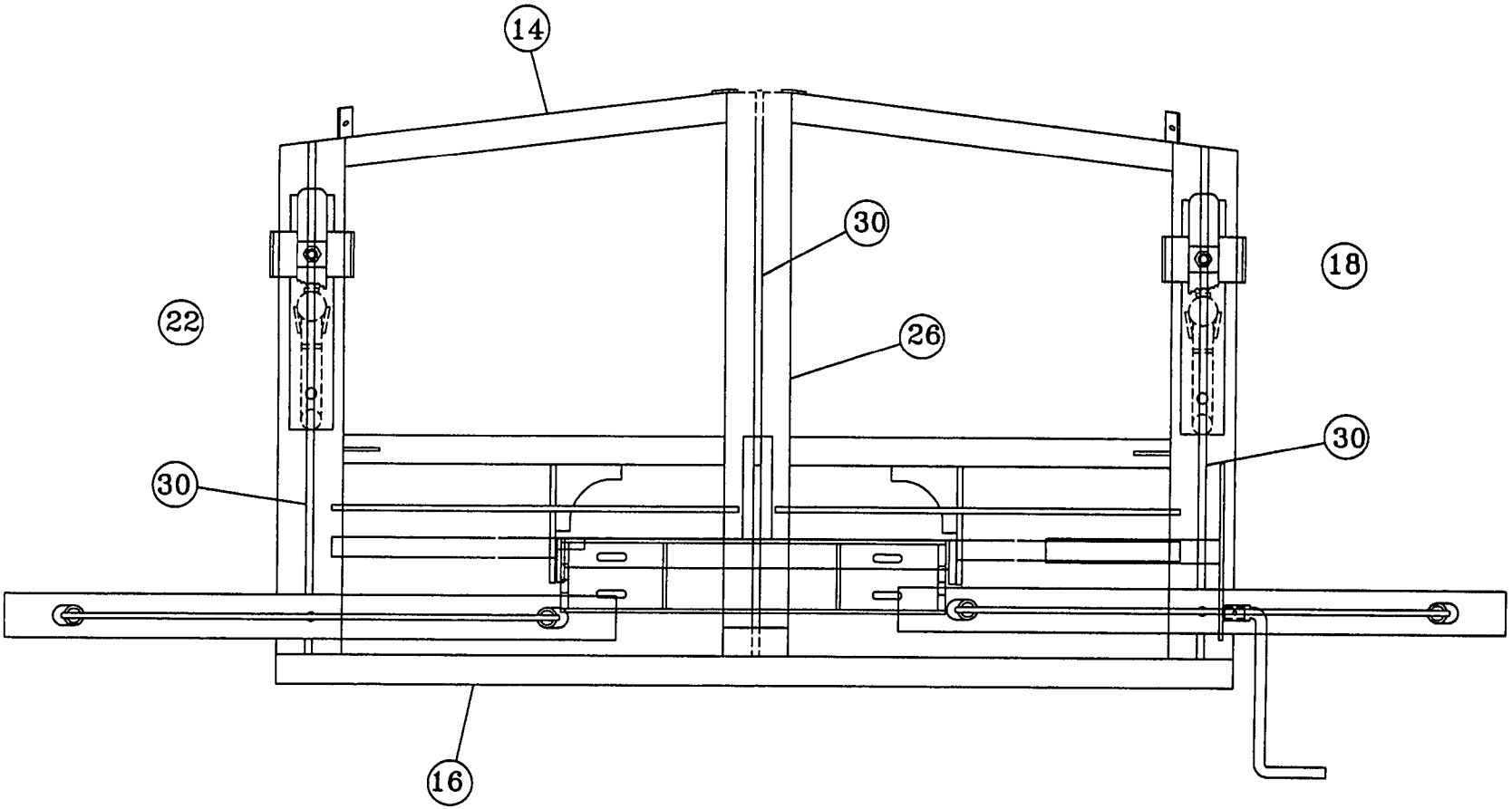
FIG. 2 is a front side view of the wire dispensing and retrieving apparatus.

In FIG. 1, a new and improved razor wire dispensing and retrieving apparatus 10 of the present invention for efficiently and safely dispensing razor wire along a perimeter is illustrated and will be described. More particularly, the apparatus 10 has a symmetrically shaped frame 12 that functions as the apparatus' main body and support. As illustrated in FIG. 2, the frame 12 comprises a top side 14, a bottom side 16, a left side 18, and a right side 22. A front face 19 and a back face 20 further define the left side 18. Similarly, a front face 23 and a back face 24 further define the right side 22. A center bar 26 is centrally placed between the frame's left 18 and right 22 sides and attached to the frame's top 14 and bottom 16 sides. A front face 27 and a back face 28 further define the center bar 26.

A slot 30 protrudes through the frame's left side 18, extending from the left side's front face 19 to the left side's back face 20. Moreover, the slot 30 extends along the left side 18, from near the frame's top side 14 to near the frame's bottom side 16. Similarly, a slot 30 protrudes through the frame's right side 22, extending from the right side's front face 23 to the right side's back face 24. The right side's slot 30 extends along the right side 22, from near the frame's top side 14 to near the frame's bottom side 16. Finally, a slot 30 protrudes through the center bar 26, extending from the center bar's front face 27 to the center bar's back face 28. The center bar's slot 30 extends along the center bar 26, from near the frame's top side 14 to near the frame's bottom side 16.

Figure 3:
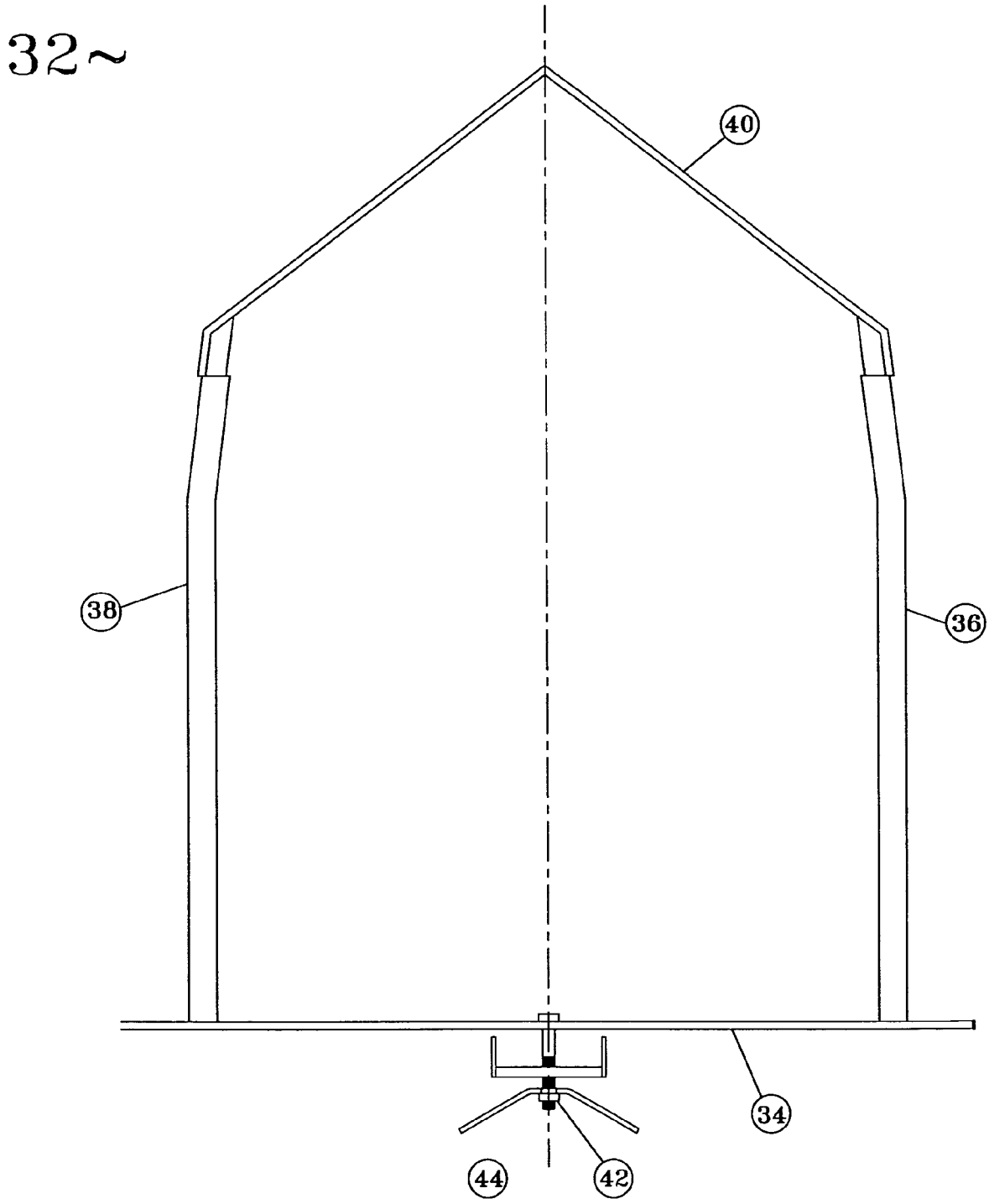
FIG. 3 is a top plan view of the apparatus' spreader.

The wire dispensing and retrieving apparatus 10 further comprises a spreader 32. As shown in FIG. 3, the spreader 32 has a base plate 34, a first rod 36, a second rod 38, a v-shaped rod 40, and a bolt 42. The first rod 36 extends perpendicularly from the spreader's base plate 34. Similarly, the second rod 38 extends perpendicularly from the spreader's base plate 34. The second rod 38 runs parallel to the first rod 36. A v-shape rod 40 is attached to the first rod 36 opposite the base plate 34. Furthermore, the v-shaped rod 40 is attached to the second rod 38 opposite the base plate 34. The spreader's bolt 42 extends perpendicularly from the base plate 34 opposite the first 36 and second 38 rods. A set of threads 44 further defines the spreader's bolt 42.

Figure 4:
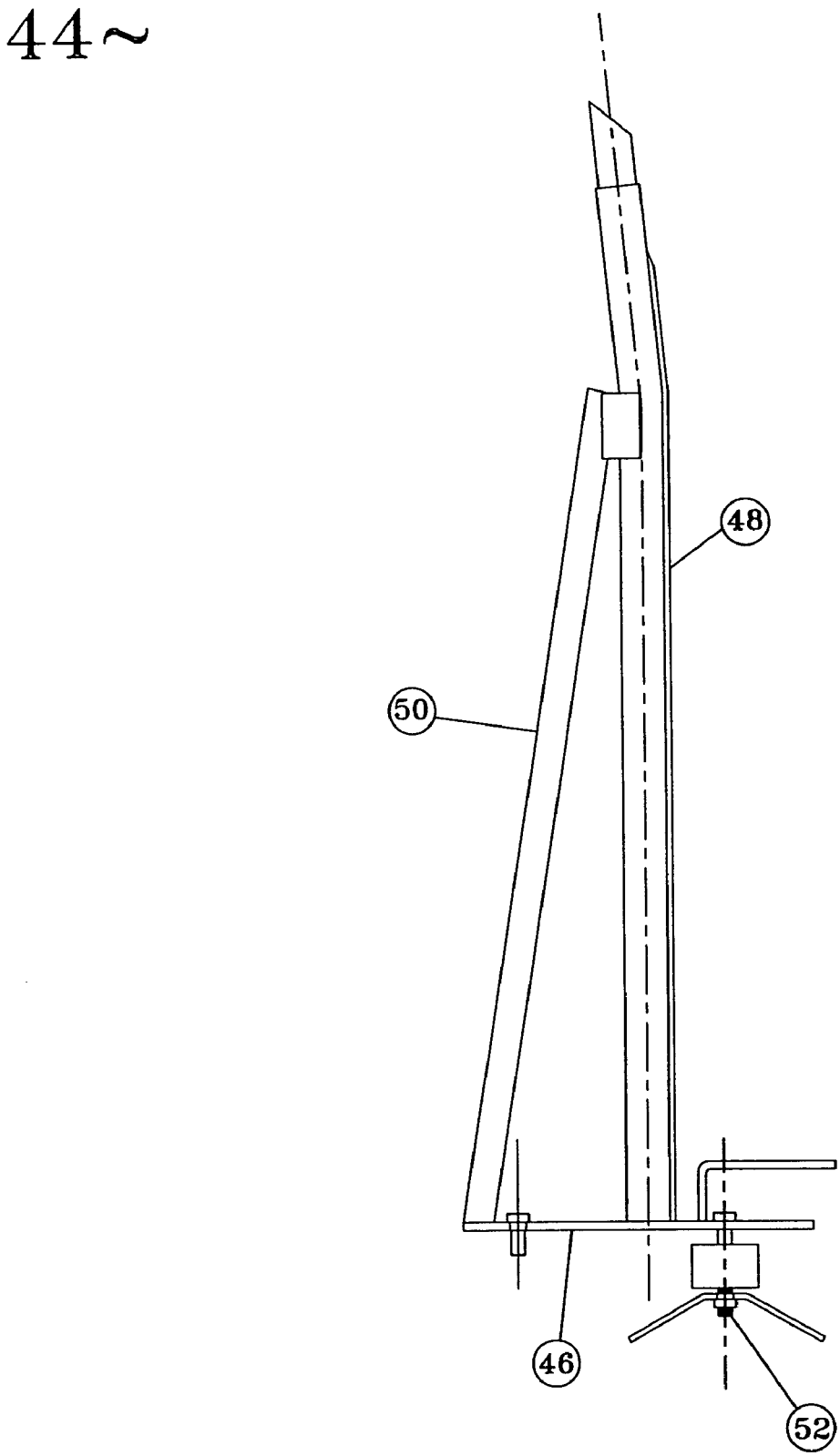
FIG. 4 is a left side view of the apparatus' hanger.

The razor wire dispensing and retrieving apparatus 10 further comprises a hanger 44. FIG. 4 illustrates the apparatus' hanger 44. The hanger 44 has a base plate 46, a boom 48, a support bar 50, and a bolt 52. The boom 46 extends perpendicularly from the base plate 46. The support bar 50 extends at an angle from the base plate 46 and attaches to the boom 48 opposite the base plate 46. The hanger's bolt 52 extends perpendicularly from the base plate 46 opposite the boom 48 and support bar 50. A set of threads 54 further defines the hanger's bolt 52.

Figure 6:
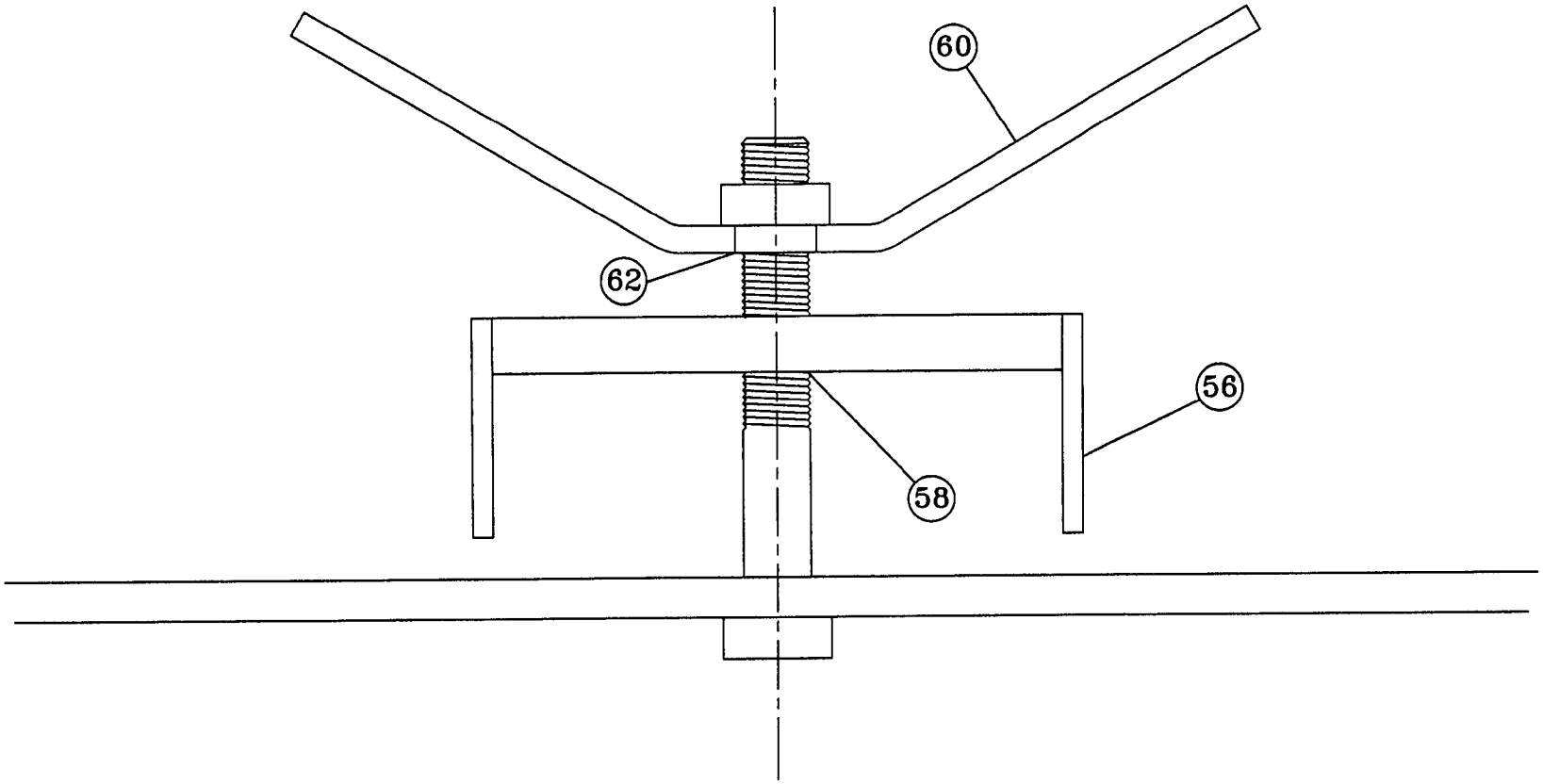
FIG. 6 is a top plan view of the apparatus' clamp and wing nut attached to a bolt.

A set of clamps 56 and wing nuts 60 are used to attach the spreader 32 and hanger 44 to the apparatus' frame 12. FIG. 6 illustrates the apparatus' clamps 56 and wing nuts 60. A bolt receptacle 58 extends through the center of the clamp 56. Similarly, a bolt receptacle 62 extends through the center of the wing nut 60. Moreover, the clamp's bolt receptacle 58 and the wing nut's bolt receptacle 62 are sized and shaped to receive both the spreader's bolt 42 and the hanger's bolt 52. The wing nut's bolt receptacle 62 is threaded to receive the spreader bolt's threads 44 and the hanger bolt's threads 54. Similarly, the slots 30 in the frames' left side 18, right side 22, and center bar 26 are sized and shaped to receive both the spreader's bolt 42 and the hanger's bolt 52.

Figure 5:
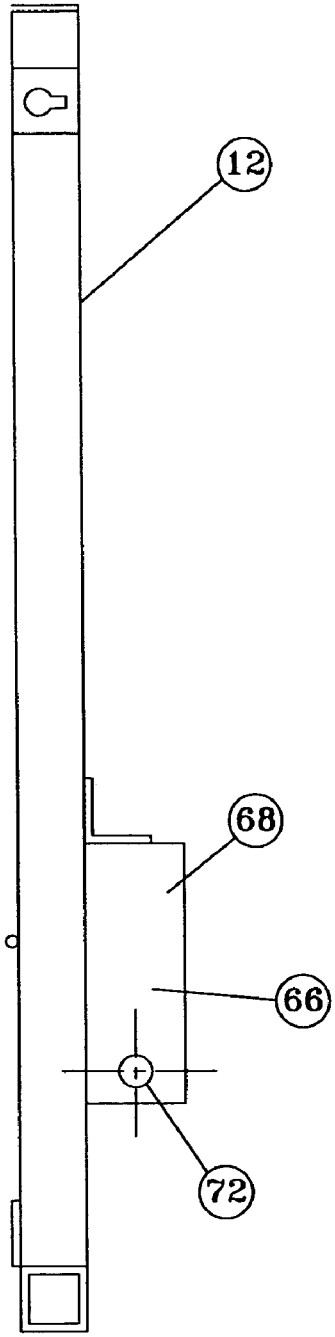
FIG. 5 is a left side view of the apparatus' extension receiver attached to the frame.

The apparatus 10 further comprises an extension receiver 64 that has a base plate 66, a left side 68, and a right side 70. FIG. 5 illustrates the apparatus' extension receiver 64. Moreover, the extension receiver 64 defines a pin receptacle 72 that extends from its left side 68 through to its right side 70. The extension receiver 64 is attached near the bottom of the frame 12 opposite the spreader 32 and hanger 44.

In addition to the extension receiver 64, the apparatus 10 has an extension bar 74. FIG. 1 illustrates the apparatus' extension bar. The extension bar has a first end 76 and a second end 78. The extension bar's first end 76 has a pin receptacle 80 extending horizontally there through. The extension bar's pin receptacle 80 is shaped and sized to receive a rod-shaped pin 84. Similarly, the extension receiver's pin receptacle 72 is shaped and sized to receive the pin 84. Furthermore, the extension bar's second end 78 has a bolt receptacle 82 extending horizontally there through.

As shown in FIG. 1, the razor wire dispensing and receiving apparatus 10 further comprises a winch frame 86. Moreover, the winch frame 86 has a first end 88 and a second end 90. The winch frame's first end 88 is removably attached to the extension bar 74. More specifically, the winch frame 86 extends vertically from the extension bar 74. A winch 92 is attached to the winch frame's second end 90. Additionally, the apparatus 10 has a cord 94 with a first end 96 and a second end 98. The cord's first end 96 is attached to the winch 92 in a manner permitting the cord 94 to be wound and unwound from the winch 92. The cord's second end is attached to the frame's top side 14.

As described, the apparatus 10 may be set up to simultaneously dispense, retrieve, or transport up to three rolls of razor wire, or concertina wire. A spreader 32 is attached to the frame 12 by sliding the spreader's bolt 42 through the slot 30 in either the left side 18, right side 22, or center bar 26. Additionally, the spreader's 32 height may be adjusted by sliding it up or down in the slot 30. The spreader 32 is secured to the frame 12 by sliding the clamp's bolt receptacle 58 over the spreader's bolt 42 and fixing the mouth of the clamp 56 onto the frame 12. Next, the wing nut 60 is threaded onto the spreader bolt's threads 44. The hanger 44 is attached to the frame 12 in a similar fashion. Thus, the apparatus' frame 12 will support three sets of spreaders 32 and hangers 44. By adjusting the spreader 32 and hanger 44 positions in the slots, the apparatus 10 can be set up to work with different sizes of razor wire rolls.

In addition to the apparatus' flexibility to be set up for different numbers and sizes of razor wire rolls, the apparatus's extension receiver 64 permits it to be transported by a variety of vehicles. The apparatus' extension bar 74 attaches to the extension receiver 64 by aligning extension receiver's pin receptacle 72 and the extension bar's pin receptacle 80 then securing the parts with a pin 84. In turn, the bolt receptacle 82 in the opposite end of the extension bar 74 may be attached to a variety of clamps, bolts, and other fastening devices. These fastening devices permit the extension bar's second end 78 to be attached to a vehicle's bumper, frame, or body. In addition, the extension receiver 64 may be directly attached to a variety of clamps, bolts, and other fastening devices. This permits the extension receiver 64 to be directly attached to a vehicles bumper, frame, or body. By using the extension bar 74 or the directly attaching the extension receiver 64 to a vehicle, the apparatus 10 has the flexibility to work with an endless number of vehicles, including tractors, backhoes, and military humvees.

In use, rolls of razor wire, or concertina wire, are hung on the boom 48. As rolls are hung on the boom 48, the spreader's v-rod 40 guides the insides of the rolls onto the spreader's first and second extension rods 36, 38. Once the wire is loaded on the boom 48, one end of the wire is attached to a fixture in the ground to create a starting point for the wire perimeter. Next, a vehicle is used to move the apparatus 10 as wire dispenses off the boom 48. As the wire is pulled off the boom 48, the first and second extension rod's 36, 38 maintain the roll's shape so the wire does not tangle. In the wire dispensing position, the spreader 32 and hanger 44 are positioned parallel to the ground.

In addition to dispensing wire, the apparatus 10 is designed to efficiently retrieve used wire. To place the apparatus 10 in the wire retrieving position, the winch 92 and cord 94 are manipulated to tilt the frame 12 so that the spreader 32 and hanger 44 angle toward the ground. As the winch 92 manipulates the frame 12. The pin 84 securing the extension receiver 64 to the extension bar 74 permits the frame 12 to pivot in relation to the fixed extension bar 74. This position permits the wire to slide up the boom 48 as a vehicle moves the apparatus 10. The angled position is preferred because the wire does not have to be lifted onto the boom 48. As the wire slides up the boom 48, the spreader's v-rod 40 guides the insides of the rolls onto the spreader's first and second extension rods 36, 38. In turn, the first and second extension rod's 36, 38 maintain the wire's shape as it is collected.

Once wire is loaded or collected on the hanger 44, the apparatus 10 can be placed in the wire transport position to efficiently move the wire from one location to another. To place the apparatus 10 in the wire transport position, the winch 92 and cord 94 are manipulated to tilt the frame 12 so that the spreader 32 and hanger 44 angle toward the sky. This position permits the boom 48 to hold the wire as a vehicle moves the apparatus 10. The angled position is preferred because the wire will not slide over the end of the boom 48. During transport, the first and second extension rod's 36, 38 maintain the wire's shape and aid the boom 48 in securing the wire.

While a preferred embodiment of the fence dispensing apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, different combinations of spreaders and hangers may be used to simultaneously deploy multiple rolls of razor wire. Optionally, the winch may be replaced with a hydraulic or mechanical means of pivoting the apparatus' frame. In addition, different attachments may be connected to the apparatus' frame to permit use with a variety of vehicles. More specifically, the extension bar may be attached to a hitch, clamp, bolt, or similar attaching device. In turn, the apparatus may be hitched, clamped, bolted, or otherwise attached to the hitch receptacle, bumper, or another part of any vehicle.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claimed:

1. A razor wire dispensing and retrieving apparatus comprising:

a frame having a top side, a bottom side, a left side, and a right side, said frame's left side having a front face and a back face and defining a slot extending through said left side from said front face to said back face, said frame's right side having a front face and a back face and defining a slot extending through said right side from said front face to said back face;

a center bar, said center bar being attached to said frame's top and bottom sides at a point between said frame's left and right sides;

a spreader having a base plate, a first rod, a second rod, a v-shaped rod, and a bolt, said first rod and second rod extending perpendicularly from said base plate, said v-shaped rod attached to said first and second rods opposite said base plate, said bolt extending perpendicularly from said base plate opposite said first and second rods, and said bolt being sized and shaped to fit through said frame's left side slot and said frame's right side slot;

a hanger having a base plate, a boom, a support bar, and a bolt, said boom extending perpendicularly from said base plate, said support bar extending at an angle from said base plate and attached to said boom opposite said base plate, said bolt extending perpendicularly from said base plate opposite said boom and support bar, and said bolt being sized and shaped to fit through said frame's left side slot and said frame's right side slot;

a plurality of c-shaped clamps, said clamps defining a bolt receptacle through their center, said bolt receptacle being sized and shaped to receive both the spreader's bolt and the hanger's bolt;

a plurality of wing nuts, said wing nuts defining a bolt receptacle through their center, said bolt receptacle being sized and shaped to receive both the spreader's bolt and the hanger's bolt;

an extension receiver having a base plate, a left side, and a right side, said extension receiver's base plate being attached to said frame's bottom side opposite said spreader and said hanger, said extension receiver further defining a pin receptacle extending from its left side through its right side;

an extension bar having a first end and a second end, said extension bar's first end defining a pin receptacle there through, said extension bar's second end defining a bolt receptacle there through;

a pin, said pin being shaped and sized for slidable insertion into said extension receiver's pin receptacle and said extension bar's pin receptacle;

a winch frame having a first end and a second end, said winch frame's first end being attached to said extension bar;

a winch, said winch attached to said winch frame's second end;

a cord having a first end and a second end, said cord's first end being attached to said winch and said cord's second end being attached to said frame's top side.

2. The razor wire dispensing and retrieving apparatus of claim 1 further comprising:

a means for attaching said extension bar's second end to a motor vehicle.

3. A razor wire dispensing and retrieving apparatus comprising:

a frame having a top side, a bottom side, a left side, and a right side, said frame's left side having a front face and a back face and defining a slot extending through said left side from said front face to said back face, said frame's right side having a front face and a back face and defining a slot extending through said right side from said front face to said back face;

a center bar, said center bar being attached to said frame's top and bottom sides at a point between said frame's left and right sides;

a spreader having a base plate, a first rod, a second rod, a v-shaped rod, and a bolt, said first rod and second rod extending perpendicularly from said base plate, said v-shaped rod attached to said first and second rods opposite said base plate, said bolt extending perpendicularly from said base plate opposite said first and second rods, and said bolt being sized and shaped to fit through said frame's left side slot and said frame's right side slot;

a hanger having a base plate, a boom, a support bar, and a bolt, said boom extending perpendicularly from said base plate, said support bar extending at an angle from said base plate and attached to said boom opposite said base plate, said bolt extending perpendicularly from said base plate opposite said boom and support bar, and said bolt being sized and shaped to fit through said frame's left side slot and said frame's right side slot;

a plurality of c-shaped clamps, said clamps defining a bolt receptacle through their center, said bolt receptacle being sized and shaped to receive both the spreader's bolt and the hanger's bolt;

a plurality of wing nuts, said wing nuts defining a bolt receptacle through their center, said bolt receptacle being sized and shaped to receive both the spreader's bolt and the hanger's bolt;

and an extension receiver having a base plate, a left side, and a right side, said extension receiver's base plate being attached to said frame's bottom side opposite said spreader and said hanger, said extension receiver further defining a pin receptacle extending from its left side through its right side.

4. The razor wire dispensing and retrieving apparatus of claim 3 further comprising:

a means for attaching said extension receiver to a motor vehicle.

5. The razor wire dispensing and retrieving apparatus of claim 3 further comprising:

an extension bar having a first end and a second end, said extension bar's first end defining a pin receptacle there through, said extension bar's second end defining a bolt receptacle there through;

a pin, said pin being shaped and sized for slidable insertion into said extension receiver's pin receptacle and said extension bar's pin receptacle;

and a means for manipulating said frame to pivot at an angle with respect to said extension bar.

6. The razor wire dispensing and retrieving apparatus of claim 5 further comprising:

a means for attaching said extension bar's second end to a motor vehicle.

7. A razor wire dispensing and retrieving apparatus comprising:

a frame having a top side, a bottom side, a left side, and a right side, said frame's left side having a front face and a back face and defining a slot extending through said left side from said front face to said back face, said frame's right side having a front face and a back face and defining a slot extending through said right side from said front face to said back face;

a center bar, said center bar being attached to said frame's top and bottom sides at a point between said frame's left and right sides;

a plurality of spreaders having a base plate, a first rod, a second rod, a v-shaped rod, and a bolt, said first rod and second rod extending perpendicularly from said base plate, said v-shaped rod attached to said first and second rods opposite said base plate, said bolt extending perpendicularly from said base plate opposite said first and second rods, and said bolt being sized and shaped to fit through said frame's left side slot and said frame's right side slot;

a plurality of hangers having a base plate, a boom, a support bar, and a bolt, said boom extending perpendicularly from said base plate, said support bar extending at an angle from said base plate and attached to said boom opposite said base plate, said bolt extending perpendicularly from said base plate opposite said boom and support bar, and said bolt being sized and shaped to fit through said frame's left side slot and said frame's right side slot;

a plurality of c-shaped clamps, said clamps defining a bolt receptacle through their center, said bolt receptacle being sized and shaped to receive both the spreader's bolt and the hanger's bolt;

a plurality of wing nuts, said wing nuts defining a bolt receptacle through their center, said bolt receptacle being sized and shaped to receive both the spreader's bolt and the hanger's bolt;

and an extension receiver having a base plate, a left side, and a right side, said extension receiver's base plate being attached to said frame's bottom side opposite said spreader and said hanger, said extension receiver further defining a pin receptacle extending from its left side through its right side.

8. The razor wire dispensing and retrieving apparatus of claim 7 further comprising:

a means for attaching said extension receiver to a motor vehicle.

9. The razor wire dispensing and retrieving apparatus of claim 8 further comprising:

a means for manipulating said frame to pivot at an angle with respect to said extension bar.

10. The razor wire dispensing and retrieving apparatus of claim 9 further comprising:

a means for attaching said extension bar's second end to a motor vehicle.

11. The razor wire dispensing and retrieving apparatus of claim 7 further comprising:

an extension bar having a first end and a second end, said extension bar's first end defining a pin receptacle there through, said extension bar's second end defining a bolt receptacle there through;

and a pin, said pin being shaped and sized for slidable insertion into said extension receiver's pin receptacle and said extension bar's pin receptacle.

12. The razor wire dispensing and retrieving apparatus of claim 11 further comprising:

a winch frame having a first end and a second end, said winch frame's first end being attached to said extension bar;

a winch, said winch attached to said winch frame's second end;

and a cord having a first end and a second end, said cord's first end being attached to said winch and said cord's second end being attached to said frame's top side.

13. The razor wire dispensing and retrieving apparatus of claim 12 further comprising:

a means for attaching said extension bar's second end to a motor vehicle.

* * * * *